US011700932B2

(12) United States Patent
Seo

(10) Patent No.: US 11,700,932 B2
(45) Date of Patent: Jul. 18, 2023

(54) SEALED LIPSTICK CASE

(71) Applicant: JEONG HUN CO., LTD, Bucheon-Si (KR)

(72) Inventor: Jeung Seok Seo, Bucheon-Si (KR)

(73) Assignee: JEONG HUN CO., LTD, Bucheon-si (KR)

( * ) Notice: Subject to any disclaimer, the term of this patent is extended or adjusted under 35 U.S.C. 154(b) by 246 days.

(21) Appl. No.: 17/269,026

(22) PCT Filed: Aug. 26, 2019

(86) PCT No.: PCT/KR2019/010826
§ 371 (c)(1),
(2) Date: Feb. 17, 2021

(87) PCT Pub. No.: WO2020/045912
PCT Pub. Date: Mar. 5, 2020

(65) Prior Publication Data

US 2022/0117374 A1 Apr. 21, 2022

(30) Foreign Application Priority Data

Aug. 27, 2018 (KR) ..... 10-2018-0100490

(51) Int. Cl.

| | |
|---|---|
| ***A45D 40/06*** | (2006.01) |
| ***A45D 40/10*** | (2006.01) |
| ***A45D 40/26*** | (2006.01) |
| *A45D 40/00* | (2006.01) |

(52) U.S. Cl.
CPC ..... *A45D 40/06* (2013.01); *A45D 40/065* (2013.01); *A45D 40/10* (2013.01); *A45D 40/26* (2013.01); *A45D 2040/0006* (2013.01); *A45D 2040/0018* (2013.01); *A45D 2200/051* (2013.01)

(58) Field of Classification Search
CPC ..... A45D 40/06; A45D 40/065; A45D 2040/0006; A45D 2040/0018; A45D 2200/051
See application file for complete search history.

(56) References Cited

U.S. PATENT DOCUMENTS

| | | | | |
|---|---|---|---|---|
| 7,753,608 | B2 * | 7/2010 | Hsing | A45D 40/20 206/385 |
| 11,140,965 | B2 * | 10/2021 | Lee | A45D 40/06 |
| 11,375,796 | B2 * | 7/2022 | Lee | A45D 40/023 |

FOREIGN PATENT DOCUMENTS

| | | |
|---|---|---|
| JP | 07-213336 | 8/1995 |
| JP | 2007521900 | 8/2007 |
| KR | 100238849 | 1/2000 |
| KR | 1020120013342 | 2/2012 |
| KR | 1020120097246 | 9/2012 |

* cited by examiner

*Primary Examiner* — Jennifer C Chiang
(74) *Attorney, Agent, or Firm* — Lex IP Meister, PLLC

(57) ABSTRACT

A sealed lipstick case comprises a lipstick lift part (10), a lower main body (20), and an upper cap (30). The upper cap has an inner cap provided thereinside being in close contact with an upper part of the lower main body by a spring elastic force, and an inner hook for preventing the inner cap from being separated.

5 Claims, 6 Drawing Sheets

-- Prior Art --

SEALED LIPSTICK CASE

TECHNICAL FIELD

The present disclosure relates generally to a sealed lipstick case. More particularly, the present disclosure relates to a sealed lipstick case, which includes an inner cap in close contact with a main body coupling part of a lower main body due to elastic force of a spring provided inside an upper cap covering an upper part of a lipstick, and an inner hook preventing the removal of the inner cap so as to efficiently block the inflow of outside air to the sealed lipstick case.

BACKGROUND ART

Generally, people use a variety of cosmetics to beautify their body and face, and especially use solid lipstick or liquid lip gloss for lip makeup.

Here, in a normal lipstick container, a lid of the lipstick container is opened, and lipstick inside the lipstick container is protruded therefrom and used by rotating a lower outer case while holding a storage container filled with lipstick.

The lipstick container includes: a case maintaining an exterior thereof; a lipstick holder installed in a screw type inside the case and moved up and down along threads thereof by the rotation of the case, the lipstick holder receiving a formulaic cosmetic therein; a protection tube installed between the case and the lipstick holder such that a part of the protection tube is exposed to the outside and protecting the cosmetic while guiding the raising and lowering of the lipstick holder; a fastening cap fastened to an upper open part of the case and stably holding the protection tube; and a lid opening and closing the case.

That is, the movement of the lipstick holder is changed to linear movement by the rotation of the case and is moved up and down along the protection tube, so a stick type cosmetic stored in the lipstick holder protrudes through the upper entrance of the protection tube. A user can apply lip makeup by applying the stick type cosmetic exposed from the protection tube to lips.

However, in such a normal lipstick cosmetic container of the prior art, the case is configured to be opened or closed by the lid forcibly fitted thereto, so the opening/closing by the lid and the protruding of the stick type cosmetic are efficiently performed. However, when the lipstick cosmetic container is carried and stored, outside air is introduced to the lipstick cosmetic container, and thus the cosmetic is not completely protected. Accordingly, a lipstick container in which such a problem is solved is being proposed.

As a related prior art, there is "Sealed structure of lipstick cosmetics container" disclosed in Korean Utility Model Application Publication No. 20-2015-0004424 (published on Dec. 10, 2015).

The sealed structure of lipstick cosmetics container of the prior art includes: a cylindrical container body 110, and a protection tube 130 and a cosmetic holder 140 fastened to the cylindrical container body 110 by the fastening cap 150, wherein with the stick type cosmetic C provided in the cosmetic holder 140, the cosmetic holder 140 is guided by the protection tube 130 due to the rotation of the container body 110, and the stick type cosmetic C protrudes to the outside. In the lipstick cosmetic container opened and closed by a separate lid 120, a sealing member 200 is fastened to the inside of the lid 120 by forcible fitting, and the sealing member 200 is made of a material such as TPE, rubber, or silicon to have a cylindrical shape, and has at least one holding protrusion 210 formed on the outer circumferential surface thereof by protruding therefrom, wherein the holding protrusion 210 is held in the inner circumferential surface of the lid by being in close contact therewith. A close-contact groove 220 having inner and outer slopes 221 and 222 formed at an end of the front of the sealing member 200 is formed in a circumferential direction of the sealing member 200, and is configured to be in close contact with and fastened to an end of the protection tube 130.

In addition, the front of the sealing member 200 is formed as a flat surface 223, and is configured to be in close contact with and be fastened to the entrance of the front of the protection tube 130.

However, in the prior art, the sealing member 200 fastened to the inside of the lid by forcible fitting is made of rubber or silicon having elastic force. Accordingly, during the long use of the sealing member 200, the elastic force of the sealing member 200 deteriorates and thus sealing force thereof is decreased.

Additionally, in the prior art, the close-contact groove 220 having the inner and outer slopes 221 and 222 is formed at the end of the front of the sealing member 200 in the circumferential direction thereof, and is in close contact and coupled to the entrance of the front of the protection tube 130. However, when the close-contact groove 220 is misused, the close-contact groove 220 is not in close contact with the protection tube 130 due to disagreement of the close-contact groove 220 with the entrance of protection tube 130.

DISCLOSURE

Technical Problem

The present disclosure has been made keeping in mind the above problems occurring in the prior art, and is intended to provide a sealed lipstick case, which includes an inner cap moved up and down by the elastic force of a spring and provided inside an upper cap coupled to a lower main body, and a sealing means of doubly sealing during the coupling of the upper cap and the lower main body to each other due to the elastic force of the spring, whereby during the coupling of the upper cap and the lower main body to each other, a lipstick can be tightly sealed.

Technical Solution

In order to accomplish the above objectives, the present disclosure provides a sealed lipstick case used by allowing a lipstick to be moved up and down due to rotation of the lipstick, the sealed lipstick case including: a lipstick lift part enabling the lipstick to be moved up and down during the rotation of the lipstick; a lower main body having a coupling part formed therein by extending upward from an inner lower surface of the lower main body such that a lower inner circumferential surface of the lipstick lift part is fitted over and coupled to the coupling part; and an upper cap having a lower inner circumferential surface coupled to an upper outer circumferential surface of the lower main body, wherein the upper cap has a sealing part provided therein, the sealing part including: a fitting support end forcibly fitted to an upper inner surface of the upper cap; an inner hook having a pair of holding parts extending downward from a lower surface of the fitting support end; an inner cap having a hook holding end provided thereon such that the holding parts are coupled to an inner circumferential surface of the hook holding end by being inserted thereto; and a spring sitting on an outer circumferential surface of the hook holding end such that the inner hook and the inner cap are spaced apart from each other by facing each other.

A holding jaw may be formed at a lower end part of each of the holding parts by protruding outward therefrom, and a pair of insertion holes may be formed through the hook holding end such that the holding jaw is held in each of the insertion holes.

A main body coupling part may be formed at an upper part of the lower main body by being recessed inward therefrom such that the main body coupling part is coupled to an inner circumferential surface of the upper cap; a close contact end may be provided at a lower part of the inner cap such that the close contact end is coupled to an upper outer circumferential surface of the main body coupling part by being in close contact therewith; multiple flexible fastening ends may be formed at a lower end part of the close contact end by being spaced apart from each other by predetermined distances along a circumference thereof such that each of the flexible fastening ends is easily flexible inward and outward when the lower end part of the close contact end is coupled to the upper outer circumferential surface of the main body coupling part; and a curved support end may be formed on an upper inner circumferential surface of the close contact end by being recessed therefrom to be curved inward such that the curved support end is in close contact with an upper end of the main body coupling part.

A repressed fastening end groove may be formed in an outer circumferential surface of the main body coupling part by being repressed inward therefrom such that an inner surface of the flexible fastening end sits in the repressed fastening end groove; a ring-shaped coupling jaw may be formed at a part located under the repressed fastening end groove by protruding outward therefrom such that the coupling jaw is coupled to the lower inner circumferential surface of the upper cap; and a ring-shaped lower cap-coupling jaw may be formed on the lower inner circumferential surface of the upper cap by protruding therefrom such that the lower cap-coupling jaw is held by a lower end part of the coupling jaw when the lower cap-coupling jaw sits on the main body coupling part by being fastened thereto.

The coupling jaw and the lower cap-coupling jaw may include a pair of coupling jaws and a pair of lower cap-coupling jaws, respectively, provided by being spaced apart from each other by a predetermined distance such that a fastening force of the coupling jaw to the lower cap-coupling jaw is increased.

A support end holding jaw may be provided on an upper inner circumferential surface of the upper cap by protruding inward therefrom such that a lower end part of the fitting support end is supported by the support end holding jaw when the fitting support end is forcibly fitted to the upper inner circumferential surface of the upper cap.

Advantageous Effects

The sealed lipstick case according to the present disclosure has the following effects.

First, the sealing part is provided inside the upper cap such that the sealing part is in close contact with the upper end of the lower main body due to the operation of the elastic force of the spring, thereby efficiently blocking outside air and preventing the contamination, solidification, or deterioration of a lipstick.

Second, the spring is provided in the sealing part to generate elastic force such that the inner hook and the inner cap are spaced apart from each other, so the close contact end of the inner cap is in close contact with the main body coupling part of the lower main body due to the elastic force of the spring, thereby facilitating the sealing of the sealed lipstick case.

Third, the holding part is provided on the lower surface of the fitting support end of the inner hook, and the hook holding end is provided on the inner cap such that the holding part is inserted to and held in the holding end, so during the decoupling of the lower main body from the upper cap, the removal of the inner cap to the outside due to the elastic force of the spring is prevented, thereby enabling the stable use of the sealed lipstick case.

Fourth, when the flexible fastening end of the close contact end sits in the repressed fastening end groove of the main body coupling part, the curved support end formed on the upper inner circumferential surface of the close contact end is in close contact with the upper end of the main body coupling part, thereby improving the sealing force of the inner cap.

BEST MODE

Figure 1:
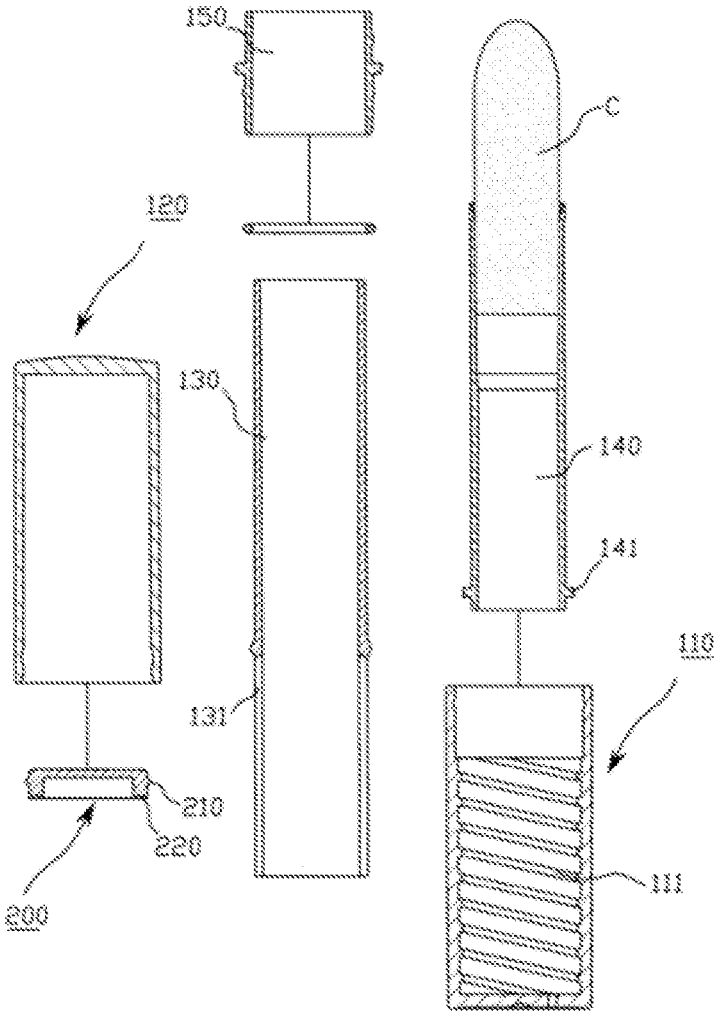
FIG. 1 is a view illustrating a sealing structure of a lipstick cosmetic container according to a prior art.
Figure 2:
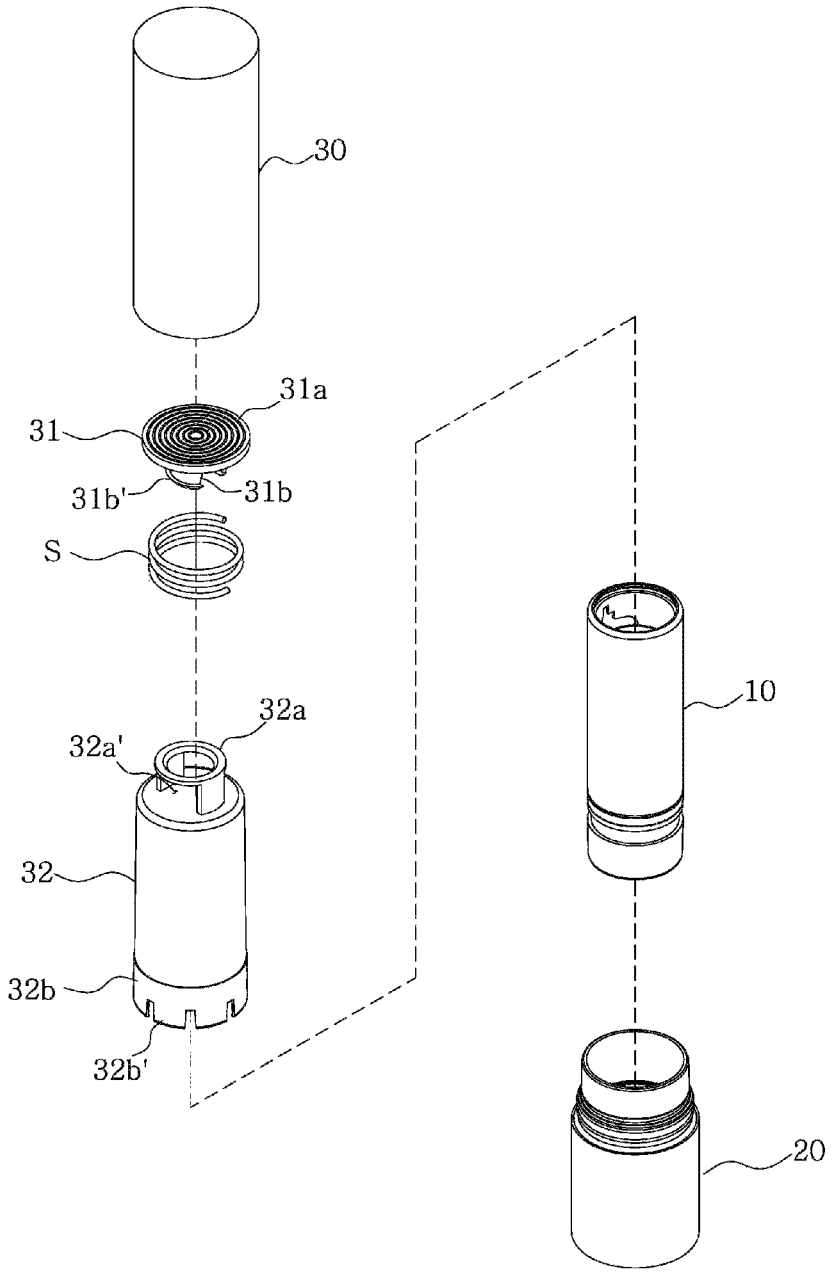
FIG. 2 is an exploded perspective view of a sealed lipstick case according to the present disclosure.

Hereinafter, an embodiment of a sealed lipstick case according to the present disclosure will be described in detail with reference to the accompanying drawings.

As illustrated in FIGS. 2 to 6, the sealed lipstick case according to the present disclosure used by allowing a lipstick R to be moved up and down due to rotation of the lipstick R includes: a lipstick lift part 10 enabling the lipstick R to be moved up and down during the rotation of the lipstick R; a lower main body 20 having a coupling part 21 formed therein by extending upward from an inner lower surface of the lower main body 20 such that a lower inner circumferential surface of the lipstick lift part 10 is fitted over and coupled to the coupling part 21; and an upper cap 30 having a lower inner circumferential surface coupled to an upper outer circumferential surface Of the lower main body 20, wherein the upper cap 30 has a sealing part 35 provided therein, the sealing part 35 comprising: a fitting support end 31*a* forcibly fitted to an upper inner surface of the upper cap 30; an inner hook 31 having a pair of holding parts 31*b* extending downward from a lower surface of the fitting support end 31*a*; an inner cap 32 having a hook holding end 32*a* provided thereon such that the holding parts 31*b* are coupled to an inner circumferential surface of the hook holding end 32*a* by being inserted thereto; and a spring S sitting on an outer circumferential surface of the hook holding end 32*a* such that the inner hook 31 and the inner cap 32 are spaced apart from each other by facing each other.

Here, the upper end of the spring S is supported by the lower surface of the fitting support end 31*a*, and the lower end of the spring S is supported by the upper surface of the inner cap 32 located under the hook holding end 32*a*, whereby the inner hook 31 and the inner cap 32 push each other to face each other by using the elastic force. That is, during the coupling of the lower main body 20 to the upper cap 30, the elastic force of the spring S brings the lower part of the inner cap 32 into close contact with the upper part of the lower main body 20. Additionally, during the decoupling of the lower main body 20 from the upper cap 30, the removal of the inner cap 32 to the outside is prevented by the operation of the holding part 31*b* and the hook holding end 32*a*.

In addition, a holding jaw 31*b*' is formed at a lower end part of each of the holding parts 31*b* by protruding outward therefrom, and a pair of insertion holes 32*a*' are formed through the hook holding end 32*a* such that the holding jaw 31*b*' is held in each of the insertion holes, so the holding jaw 31*b*' prevents the inner cap 32 from being removed to a part located under the upper cap 30.

Figure 3:
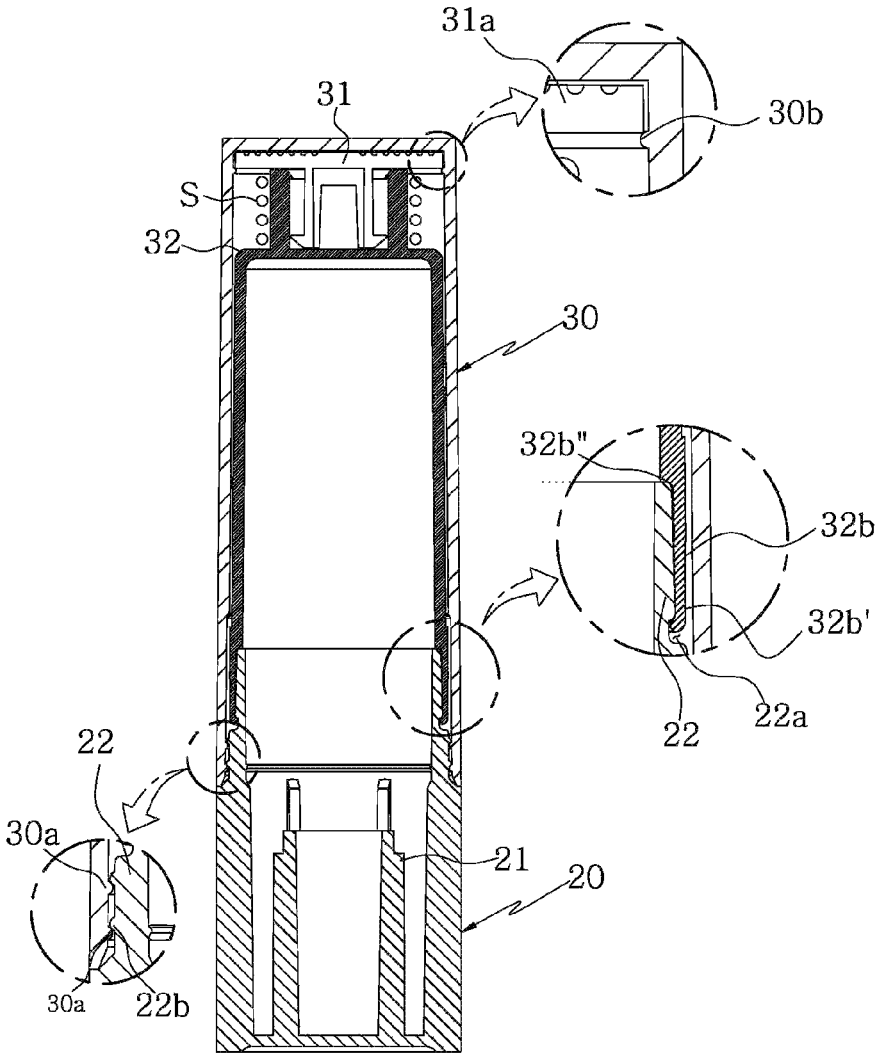
FIG. 3 is a sectional view of the sealed lipstick case according to the present disclosure.
Figure 4:
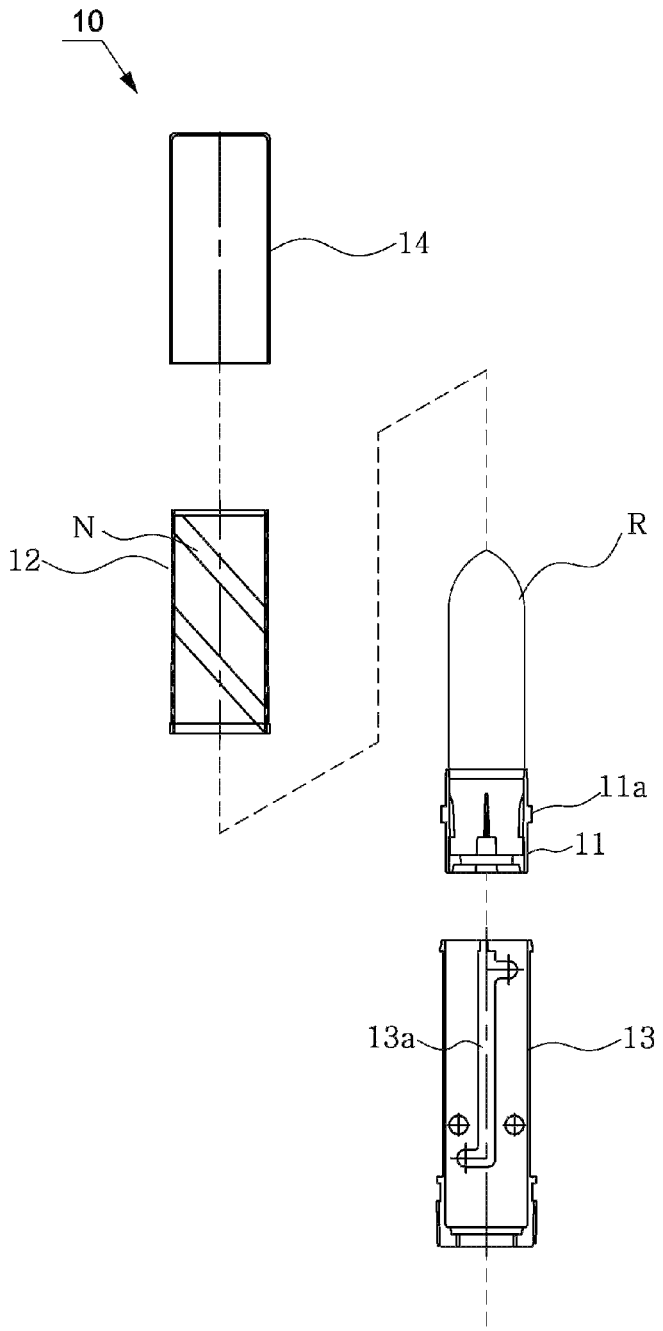
FIG. 4 is a view illustrating a lipstick lift part according to the present disclosure.
Figure 5:
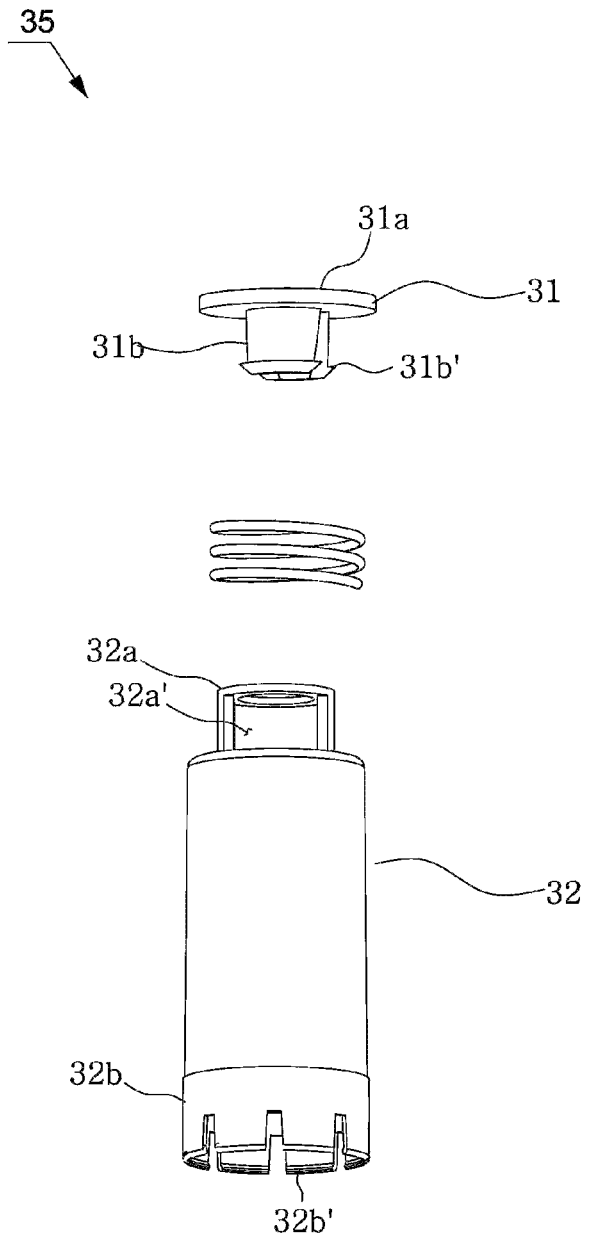
FIG. 5 is a view illustrating a sealing part according to the present disclosure.
Figure 6:
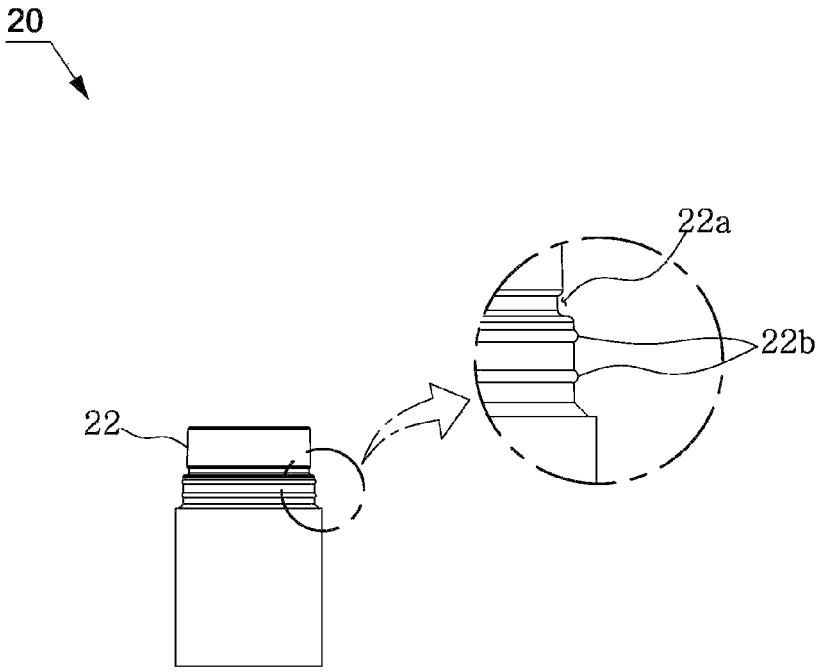
FIG. 6 is a perspective view of a lower main body according to the present disclosure.

Furthermore, a main body coupling part 22 is formed at an upper part of the lower main body 20 by being recessed inward therefrom such that the main body coupling part 22 is coupled to an inner circumferential surface of the upper cap 30, and a close contact end 32*b* is provided at a lower part of the inner cap 32 such that the close contact end 32*b* is coupled to an upper outer circumferential surface of the main body coupling part 22 by being in close contact therewith. Here, as illustrated in FIG. 3, the inner circumferential surface of the close contact end 32*b* is formed by being recessed toward the inside of the inner cap 32 more than the upper part of the inner cap 32.

Multiple flexible fastening ends 32*b*' are formed at a lower end part of the close contact end 32*b* by being spaced apart from each other by predetermined distances along a circumference thereof such that each of the flexible fastening ends 32*b*' is easily flexible inward and outward when the lower end part of the close contact end 32*b* is coupled to the upper outer circumferential surface of the main body coupling part 22, and a curved support end 32*b*" is formed on an upper inner circumferential surface of the close contact end 32*b* by being recessed therefrom to be curved inward such that the curved support end 32*b*" is in close contact with an upper end of the main body coupling part 22.

A repressed fastening end groove 22*a* is formed in an outer circumferential surface of the main body coupling part 22 by being repressed inward therefrom such that an inner surface of the flexible fastening end 32*b*' sits in the repressed fastening end groove 22*a*; a ring-shaped coupling jaw 22*b* is formed at a part located under the repressed fastening end groove 22*a* by protruding outward therefrom such that the coupling jaw 22*b* is coupled to the lower inner circumferential surface of the upper cap 30; and a ring-shaped lower cap-coupling jaw 30*a* is formed on the lower inner circumferential surface of the upper cap 30 by protruding therefrom such that the lower cap-coupling jaw 30*a* is held by a lower end part of the coupling jaw 22*b* when the lower cap-coupling jaw 30*a* sits on the main body coupling part 22 by being fastened thereto, so the coupling of the main body coupling part 22 and the upper cap 30 is improved.

Meanwhile, the flexible fastening end 32*b*' and the curved support end 32*b*" of the close contact end 32*b* sit in and are in close contact with the repressed fastening end groove 22*a* and the upper end of the main body coupling part 22, respectively.

Additionally, the coupling jaw 22*b* and the lower cap-coupling jaw 30*a* include a pair of coupling jaws 22*b* and a pair of lower cap-coupling jaws 30*a*, respectively, provided by being spaced apart from each other by a predetermined distance such that a fastening force of the coupling jaw 22*b* to the lower cap-coupling jaw 30*a* is increased, so the fastening force of the coupling jaw 22*b* to the lower cap-coupling jaw 30*a* is improved compared to when a coupling jaw 22*b* and a lower cap-coupling jaw 30*a* are provided.

A support end holding jaw 30*b* is provided on the upper inner circumferential surface of the upper cap 30 by protruding inward therefrom such that the lower end part of the fitting support end 31*a* is supported by the support end holding jaw 30*b* when the fitting support end 31*a* is forcibly fitted to the upper inner circumferential surface of the upper cap 30, so the inner hook 31 is securely coupled to and held by the upper inner circumferential surface of the upper cap 30.

Meanwhile, the lipstick lift part 10 according to the embodiment of the present disclosure includes: a lipstick holder 11 having the lipstick R filled on the upper inner circumferential surface of the lipstick holder 11 and a pair of raising/lowering protrusions 11*a* formed on the outer circumferential surface of the lipstick holder 11 by protruding outward therefrom to face each other; a rotation guide tube 12 having threads N formed in an inner circumferential surface thereof to guide the raising/lowering of the lipstick holder 11, the threads N allowing the raising/lowering protrusions 11*a* to sit therein; a holder guide tube 13 having a pair of guide paths 13*a* formed vertically therethrough such that the upper outer circumferential surface of the holder guide tube 13 is fitted to the inner circumferential surface of the rotation guide tube 12 and the raising/lowering protrusions 11*a* of the lipstick holder 11 sit in the threads N of the rotation guide tube 12 by passing through the holder guide tube 13; and a guide protection tube 14 covering the upper end part of the holder guide tube 13 and being in close contact with the outer circumferential surface of the rotation guide tube 12.

Various embodiments of the lipstick lift part 10 are disclosed in a conventional technology.

The lipstick lift part 10 is not limited to the embodiment described above, but may be variously embodied. lipstick holder 11 is moved up and down during the rotation of the lower main body 20.

In addition, the holder guide tube 13 is provided to be integrated with the coupling part 21 formed inside the lower main body 20 such that the lower part of the holder guide tube 13 is coupled to the coupling part 21, and with the guide protection tube 14 and the rotation guide tube 12 fixed, the lipstick holder 11 is moved up and down during the rotation of the lower main body 20.

The operation of the sealed lipstick case having the above configuration according to the present disclosure will be described below.

As illustrated in FIGS. 2 to 6, in the sealed lipstick case according to the present disclosure, the inner cap 32 moved to face the inner hook 31 is provided such that the lower end of the sealing part 35 provided inside the upper cap 30 is in close contact with the upper end of the lower main body 20, and the inner cap 32 is moved by the elastic force of the spring S.

Here, in the inner hook 31, the fitting support end 31*a* is coupled to and held in the upper part of the support end holding jaw 30*b* formed on the upper inner circumferential surface of the upper cap 30 by forcible fitting.

Meanwhile, the spring S is supported by the lower surface of the fitting support end 31*a* and the elastic force of the spring S is applied to the surface of the inner cap 32 located under the hook holding end 32*a*, so the inner cap 32 is moved to the upper part of the lower main body 20. Additionally, to prevent the removal of the inner cap 32 due to the elastic force of the spring S applied to the inner cap 32, the holding jaw 31*b*' formed on the holding part 31*b* of the inner hook 31 is held in the insertion hole 32*a*' of the hook holding end 32*a*, so in spite of the application of the elastic force of the spring S, the inner cap 32 is prevented from being removed to the outside.

Furthermore, the multiple flexible fastening ends 32*b*' are formed at the lower end part of the close contact end 32*b* provided at the lower part of the inner cap 32 by cutting the lower end part of the close contact end 32*b* such that the multiple flexible fastening ends 32*b*' are spaced apart from each other by predetermined distances, so the multiple flexible fastening ends 32*b*' are easily coupled to the main body coupling part 22 of the lower main body 20. That is, the flexibility of the flexible fastening ends 32*b*' allows the close contact end 32*b* of the inner cap 32 to be easily fitted over and coupled to the outer circumferential surface of the main body coupling part 22.

Accordingly, as for the close contact end 32, when the flexible fastening end 32*b*' sits in the repressed fastening end groove 22*a* of the main body coupling part 22, the curved support end 32*b*" of the upper inner surface of the close contact end 32*b* is in close contact with the upper end of the main body coupling part 22, so sealing force of the sealed lipstick case is improved.

In addition, the pair of coupling jaws 22*b* is formed on the outer circumferential surface of the main body coupling part 22, and the upper part of the lower cap-coupling jaw 30*a* of the lower inner circumferential surface of the upper cap 30 is in contact with the lower part of each of the coupling jaws 22*b* so as to seal the sealed lipstick case. The lower cap-coupling jaw 30*a* and the coupling jaw 22*b* include a pair of lower cap-coupling jaws 30*a* and a pair of coupling jaws 22*b*, respectively, whereby the sealing force between the lower main body 20 and the upper cap 30 is improved, and the elastic force of the spring S acts to lift the upper cap 30, so the sealing force between the lower cap-coupling jaw 30*a* and the coupling jaw 22*b* is further improved.

Accordingly, in the sealed lipstick case of the present disclosure, due to the sealing-type coupling of the upper cap 30 by which the lower main body 20 receiving the lipstick R and the sealing part 35 are coupled to the inside of the upper cap 30, the lipstick R is tightly sealed from outside air and can be prevented from being contaminated, deteriorated, and solidified.

The present disclosure is not limited to the specific exemplary embodiment described above, and anyone with ordinary knowledge in a technical field to which the present disclosure pertains can implement various modifications without departing from the gist of the present disclosure claimed in the claims. Such modifications fall within the scope of the description of the claims.

| <Description of the Reference Numerals in the Drawings> |
|---|
| 10: Lipstick lift part |
| 11: Lipstick holder |
| 11a: Raising/lowering protrusion |
| 12: Rotation guide tube |
| 13: Holder guide tube |
| 13a: Guide path |
| 14: Guide protection tube |
| 20: Lower main body |
| 21: Coupling part |
| 22: Main body coupling part |
| 22a: Repressed fastening end groove |
| 22b: Coupling jaw |

-continued

| <Description of the Reference Numerals in the Drawings> |
|---|
| 30: Upper cap |
| 30a: Lower cap-coupling jaw |
| 30b: Support end holding jaw |
| 31: Inner hook |
| 31a: Fitting support end |
| 31b: Holding part |
| 31b': Holding jaw |
| 32: Inner cap |
| 32a: Hook holding end |
| 32a': Insertion hole |
| 32b: Close contact end |
| 32b': Flexible fastening end |
| 32b": Curved support end |
| 35: Sealing part |
| N: Thread |
| R: Lipstick |

The invention claimed is:

1. A sealed lipstick case used by allowing a lipstick (R) to be moved up and down due to rotation of the lipstick (R), the sealed lipstick case comprising:

a lipstick lift part (10) enabling the lipstick (R) to be moved up and down during the rotation of the lipstick (R);

a lower main body (20) having a coupling part (21) formed therein by extending upward from an inner lower surface of the lower main body (20); and an upper cap (30) having a lower inner circumferential surface coupled to an upper outer circumferential surface of the lower main body (20), wherein the upper cap (30) has a sealing part (35) provided therein, the sealing part (35) comprising: a fitting support end (31*a*) forcibly fitted to an upper inner surface of the upper cap (30); an inner hook (31) having a pair of holding parts (31*b*) extending downward from a lower surface of the fitting support end (31*a*); an inner cap (32) having a hook holding end (32*a*) provided thereon such that the holding parts (31*b*) are coupled to an inner circumferential surface of the hook holding end (32*a*) by being inserted thereto; and a spring (S) sitting on an outer circumferential surface of the hook holding end (32*a*) such that the inner hook (31) and the inner cap (32) are spaced apart from each other by facing each other, wherein a holding jaw (31*b*') is formed at a lower end part of each of the holding parts (31*b*) by protruding outward therefrom, and a pair of insertion holes (32*a*') are formed through the hook holding end (32*a*) such that the holding jaw (31*b*') is held in each of the insertion holes.

2. The sealed lipstick case of claim 1, wherein a main body coupling part (22) is formed at an upper part of the lower main body (20) by being recessed inward therefrom such that the main body coupling part (22) is coupled to an inner circumferential surface of the upper cap (30);

a close contact end (32*b*) is provided at a lower part of the inner cap (32) such that the close contact end (32*b*) is coupled to an upper outer circumferential surface of the main body coupling part (22) by being in close contact therewith;

multiple flexible fastening ends (32*b*') are formed at a lower end part of the close contact end (32*b*) by being spaced apart from each other by predetermined distances along a circumference thereof such that each of the flexible fastening ends (32*b*') is easily flexible inward and outward when the lower end part of the close contact end (32*b*) is coupled to the upper outer circumferential surface of the main body coupling part (22); and a curved support end (32*b*") is formed on an upper inner circumferential surface of the close contact end (32*b*) by being recessed therefrom to be curved inward such that the curved support end (32*b*") is in close contact with an upper end of the main body coupling part (22).

3. The sealed lipstick case of claim 2, wherein a repressed fastening end groove (22*a*) is formed in an outer circumferential surface of the main body coupling part (22) by being repressed inward therefrom such that an inner surface of the flexible fastening end (32*b*') sits in the repressed fastening end groove (22*a*);

a ring-shaped coupling jaw (22*b*) is formed at a part located under the repressed fastening end groove (22*a*) by protruding outward therefrom such that the coupling jaw (22*b*) is coupled to the lower inner circumferential surface of the upper cap (30); and a ring-shaped lower cap-coupling jaw (30*a*) is formed on the lower inner circumferential surface of the upper cap (30) by protruding therefrom such that the lower cap-coupling jaw (30*a*) is held by a lower end part of the coupling jaw (22*b*) when the lower cap-coupling jaw (30*a*) sits on the main body coupling part (22) by being fastened thereto.

4. The sealed lipstick case of claim 3, wherein the coupling jaw (22*b*) and the lower cap-coupling jaw (30*a*) comprise a pair of coupling jaws (22*b*) and a pair of lower cap-coupling jaws (30*a*), respectively, provided by being spaced apart from each other by a predetermined distance such that a fastening force of the coupling jaw (22*b*) to the lower cap-coupling jaw (30*a*) is increased.

5. The sealed lipstick case of claim 1, wherein a support end holding jaw (30*b*) is provided on an upper inner circumferential surface of the upper cap (30) by protruding inward therefrom such that a lower end part of the fitting support end (31*a*) is supported by the support end holding jaw (30*b*) when the fitting support end (31*a*) is forcibly fitted to the upper inner circumferential surface of the upper cap (30).

* * * * *